US008981885B2

(12) United States Patent
Ocket et al.

(10) Patent No.: US 8,981,885 B2
(45) Date of Patent: Mar. 17, 2015

(54) ELECTROMAGNETIC ACTUATOR

(71) Applicant: Tyco Electronics Belgium EC BVBA, Oostkamp (BE)

(72) Inventors: Tom Ocket, Torhout (BE); Guus Mertens, Massemen (BE); Geert De Boever, Lichtervelde (BE); Peter Devos, Wondelgem (BE); Jan Van Cauwenberge, Aalter (BE)

(73) Assignee: Tyco Electronics Belgium EC BVBA, Oostkamp (BE)

( * ) Notice: Subject to any disclaimer, the term of this patent is extended or adjusted under 35 U.S.C. 154(b) by 0 days.

(21) Appl. No.: 13/711,161

(22) Filed: Dec. 11, 2012

(65) Prior Publication Data

US 2013/0147584 A1 Jun. 13, 2013

(30) Foreign Application Priority Data

Dec. 12, 2011 (EP) ..... 11193079

(51) Int. Cl.

| | |
|---|---|
| ***H01F 7/00*** | (2006.01) |
| ***H01F 3/00*** | (2006.01) |
| ***H01F 7/124*** | (2006.01) |
| ***H01F 7/127*** | (2006.01) |
| ***H01F 7/16*** | (2006.01) |

(52) U.S. Cl.

CPC ..... *H01F 3/00* (2013.01); *H01F 7/124* (2013.01); *H01F 7/127* (2013.01); *H01F 7/1607* (2013.01)

USPC ..... 335/235; 335/234

(58) Field of Classification Search

USPC ..... 335/235

See application file for complete search history.

(56) References Cited

U.S. PATENT DOCUMENTS

| | | | | | |
|---|---|---|---|---|---|
| 2,324,642 | A | * | 7/1943 | Peterson | 335/260 |
| 2,952,756 | A | * | 9/1960 | Lanctot | 335/5 |
| 4,044,324 | A | * | 8/1977 | Coors | 335/260 |
| 4,339,109 | A | * | 7/1982 | Kawata et al. | 251/129.08 |
| 4,462,013 | A | * | 7/1984 | Ueda et al. | 335/229 |
| 4,539,542 | A | * | 9/1985 | Clark | 335/261 |
| 4,540,154 | A | * | 9/1985 | Kolchinsky et al. | 251/129.15 |
| 4,683,454 | A | * | 7/1987 | Vollmer et al. | 335/299 |
| 4,694,270 | A | * | 9/1987 | Ichihashi | 335/260 |
| RE32,783 | E | * | 11/1988 | Clark | 335/261 |

(Continued)

FOREIGN PATENT DOCUMENTS

| | | | |
|---|---|---|---|
| DE | 29903873 | U1 | 6/1999 |
| DE | 102007039148 | A1 | 2/2009 |
| DE | 102008056777 | A1 | 5/2010 |

OTHER PUBLICATIONS

Search Report issued by the European Patent Office, dated Feb. 16, 2012, for related European Patent No. 11193079.8; 8 pages.

*Primary Examiner* — Shawki S Ismail
*Assistant Examiner* — Lisa Homza
(74) *Attorney, Agent, or Firm* — Faegre Baker Daniels LLP

(57) ABSTRACT

The invention relates to an electromagnetic actuator comprising a wire coil, an armature and a catch, wherein the armature can be moved in an actuation direction, and wherein the catch secures the armature within the electromagnetic actuator. In order to secure an armature of the electromagnetic actuator, extra parts are mounted to the electromagnetic actuator or the armature is attached via a spring. This results in bigger sizes or insufficient stopping characteristics. The present invention overcomes these disadvantages by locating a catch inside the electromagnetic actuator.

14 Claims, 6 Drawing Sheets

(56) References Cited

U.S. PATENT DOCUMENTS

| | | | | | |
|---|---|---|---|---|---|
| 4,801,910 | A | | 1/1989 | Ayers et al. | |
| 4,983,941 | A | * | 1/1991 | Tanaka | 335/255 |
| 5,208,570 | A | * | 5/1993 | Nippert | 335/261 |
| 5,497,135 | A | * | 3/1996 | Wisskirchen et al. | 335/253 |
| 5,890,876 | A | * | 4/1999 | Suito et al. | 417/213 |
| 5,950,605 | A | * | 9/1999 | Hussey et al. | 123/568.26 |
| 5,960,776 | A | * | 10/1999 | Everingham et al. | 123/568.26 |
| 5,964,578 | A | * | 10/1999 | Suitou et al. | 417/222.2 |
| 6,036,447 | A | * | 3/2000 | Kawaguchi et al. | 417/222.2 |
| 6,229,421 | B1 | | 5/2001 | Floyd et al. | |
| 6,377,146 | B1 | * | 4/2002 | Batteux | 335/280 |
| 6,677,842 | B1 | * | 1/2004 | Hanke et al. | 335/177 |
| 6,799,746 | B2 | * | 10/2004 | Schafer | 251/129.07 |
| 7,414,502 | B2 | * | 8/2008 | Tackes et al. | 335/220 |
| 7,557,681 | B2 | * | 7/2009 | Whitaker et al. | 335/14 |
| 7,598,830 | B2 | * | 10/2009 | Bogdon et al. | 335/179 |
| 2007/0120081 | A1 | * | 5/2007 | Huang | 251/117 |
| 2009/0021334 | A1 | * | 1/2009 | Okada | 335/289 |

* cited by examiner

ELECTROMAGNETIC ACTUATOR

The invention relates to an electromagnetic actuator comprising a wire coil, an armature and a catch, wherein the armature can be moved in an actuation direction, and wherein the catch secures the armature within the electromagnetic actuator.

Electromagnetic actuators often comprise a wire coil and an armature that is located inside the wire coil and can be moved in an actuation direction by running a current through the wire coil. In order to avoid that the armature falls out of the wire coil, an extra part can be mounted to the wire coil. As many actuators also comprises a spring that biases the armature against the actuation direction, a second option to keep the armature and the wire coil together would be to fix the spring to the armature on one end and to the wire coil on the other end.

However, mounting an extra part increases the size of the actuator and connecting the wire coil and the armature via the spring does not provide a reliable stop. Therefore, the problem to be solved is to provide a stopping mechanism that has a reliable stopping characteristic and does not increase the size of the actuator.

The present invention solves this problem by using a catch that secures the armature within the electromagnetic actuator, wherein the catch is located inside the electromagnetic actuator.

Locating the catch inside the actuator does not increase the size of the electromagnetic actuator, but still gives a defined stopping characteristic. Further, as the catch is located at the inside, it cannot be damaged in rough environments. Furthermore, as the shape of the actuator does not change, an actuator comprising a catch on the inside can be mounted to the same basis as an electromagnetic actuator without the catch.

The solution according to the invention may be combined as desired with the following further advantageous improvements.

The electromagnetic actuator can have an insertion direction along which the armature is inserted into the electromagnetic actuator during assembly and against which the armature is secured by the catch. The armature can easily be mounted by simply introducing the armature into the electromagnetic actuator. After assembly, the armature is secured against falling out, for example during transport or when handling the electromagnetic actuator.

It is advantageous if the actuation direction is the insertion direction, as in this case the assembly of the armature to the electromagnetic actuator can be simply done by inserting the armature without further steps e.g. relocating the armature.

The electromagnetic actuator can further comprise a tube that is located between the armature and the wire coil. Such a tube has the advantage that it reduces the friction between the armature and the wire coil. The tube can either be fixed to the wire coil or to the armature or it can be mounted loosely between the two. Preferably, the tube is made from a material that has a low friction coefficient. In order to keep manufacturing costs low, the tube can be made from a sheet material that is rolled, bent or deepdrawn. If the tube is made from a plastic material, it could easily be produced by injection molding.

In an advantageous development, the tube comprises a tongue that acts as a catch. As the tube is located between the wire coil and the armature, a catch, located on the tube results in a direct contact between the two. For example, if the tube is fixed to the wire coil, such a tongue can engage in a recess located on the armature.

The tongue can be stamped or cut out from the tube in order to save costs.

In a preferred embodiment, the catch has a first shoulder that engages with a second shoulder, the second shoulder being located on the armature. Although the first and the second shoulder might be located on the wire coil and a tube that is attached to the armature, locating the second shoulder on the armature is advantageous, as in this case the mass that is moved is kept at a minimum, which reduces the force applied to the shoulders during the catching process. Further, if little mass has to be moved, the response time of the actuator can be shorter.

The first and/or the second shoulder can be located on a recess and/or a protrusion. A recess might be for example a hole, a groove or an opening. A protrusion could be a step or a tongue. For instance, the first and second shoulder could each be located on a protrusion. In a preferred embodiment, a recess is located on the armature and a shoulder located on the tube or the wire coil engages in the recess of the armature.

In an advantageous development, the first and/or the second shoulder extends along a circumferential direction around the actuation direction. This allows a partial rotation of the armature relative to the wire coil. Preferably, the first and/or the second shoulder extends along the entire circumference around the actuation direction. In this case, the armature can rotate freely inside the wire coil. An armature with a shoulder along the entire circumference can be manufactured easily by turning.

In a further advantageous development, the catch is integrally formed with a component of the electromagnetic actuator, the component being the armature, the wire coil, a tube or a bobbin. However, the catch can also be formed integral with further components. Such a one-piece design of the catch together with a component of the actuator can save costs, as no additional components have to be manufactured and/or mounted. Furthermore, such a compact design can save space in and on the actuator.

It is advantageous if the catch is elastic or elastically deflectable in a direction perpendicular to the actuation direction. For example, the catch might snap into a recess, which allows an easy mounting process in one direction but prevents the armature from falling out in the other direction. During assembly, the armature can be inserted into the actuator by deflecting the catch and, in the assembled state, the catch secures the armature inside the actuator.

The invention will be described hereinafter in greater detail and in an exemplary manner using advantageous embodiments and with reference to the drawings. The described embodiments are only possible configurations in which, however, the individual features as described above can be provided independently of one another or can be omitted.

Figure 1:
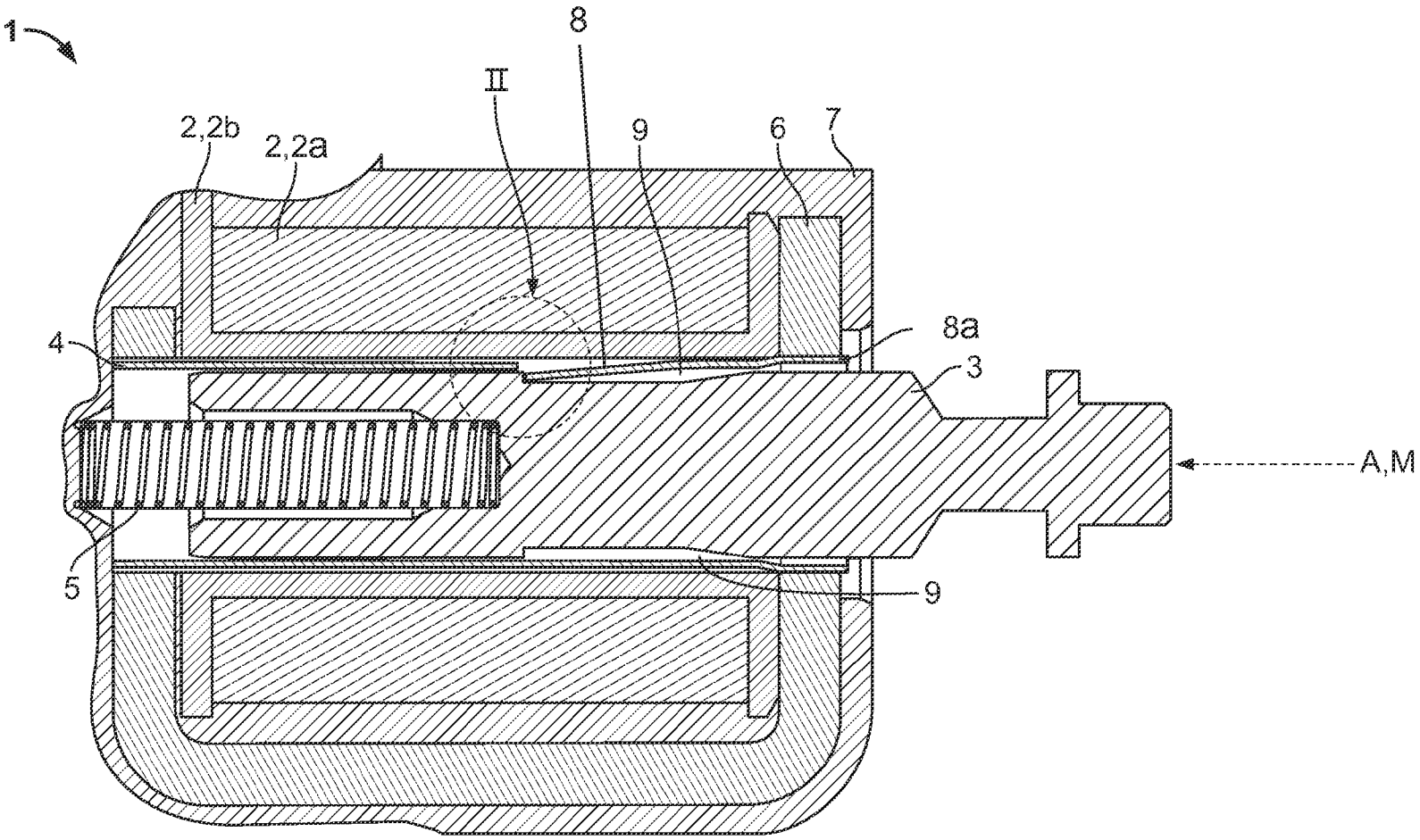
FIG. 1 is a schematic sectional side view of an electromagnetic actuator according to the invention.

FIG. 1 shows a schematic sectional side view of an electromagnetic actuator 1 according to the invention. The electromagnetic actuator 1 comprises a wire coil 2, an armature 3, a tube 4, a spring 5, a yoke 6 and a housing 7. The wire coil 2 comprises wires 2*a* and a bobbin 2*b*.

The armature 3 can be moved in the actuation direction A by running a current through the wire coil 2. The spring 5 biases the armature 3 against the actuation direction A. The yoke 6 can help to increase and direct the magnetic field induced by the current running through the wire coil 2. Further, the yoke 6 can serve to increase the stability of the electromagnetic actuator 1. A housing 7 can serve to protect the electromagnetic actuator 1 and/or can be part of a mounting assembly used to mount the electromagnetic actuator 1.

The actuation direction A is also the insertion direction M along which the armature 3 was inserted into the electromagnetic actuator 1 during assembly.

The electromagnetic actuator 1 further comprises a catch 8 that engages with a recess 9 of the armature 3. In this example, the catch 8 is part of the tube 4. The tube 4 is fixed to the yoke 6. The armature 3 can move within the tube 4 but its movement in the actuation direction A is limited by the catch 8. The catch 8 thus secures the armature 3 within the electromagnetic actuator 1 and prevents the armature from falling out.

The recess 9 extends along the entire circumference of the armature 3. The catch 8 is formed as a tongue 8*a* in the tube 4 and in this example does not extend around the actuation direction A along an entire circumference. The tongue 8*a* is formed by stamping out a part of the tube 4. The tube 4 has been produced by rolling a piece of sheet metal and joining the ends together, for example by welding or soldering. However, the tube 4 could also be formed by injection molding if the tube is made from a plastic material.

Figure 2:
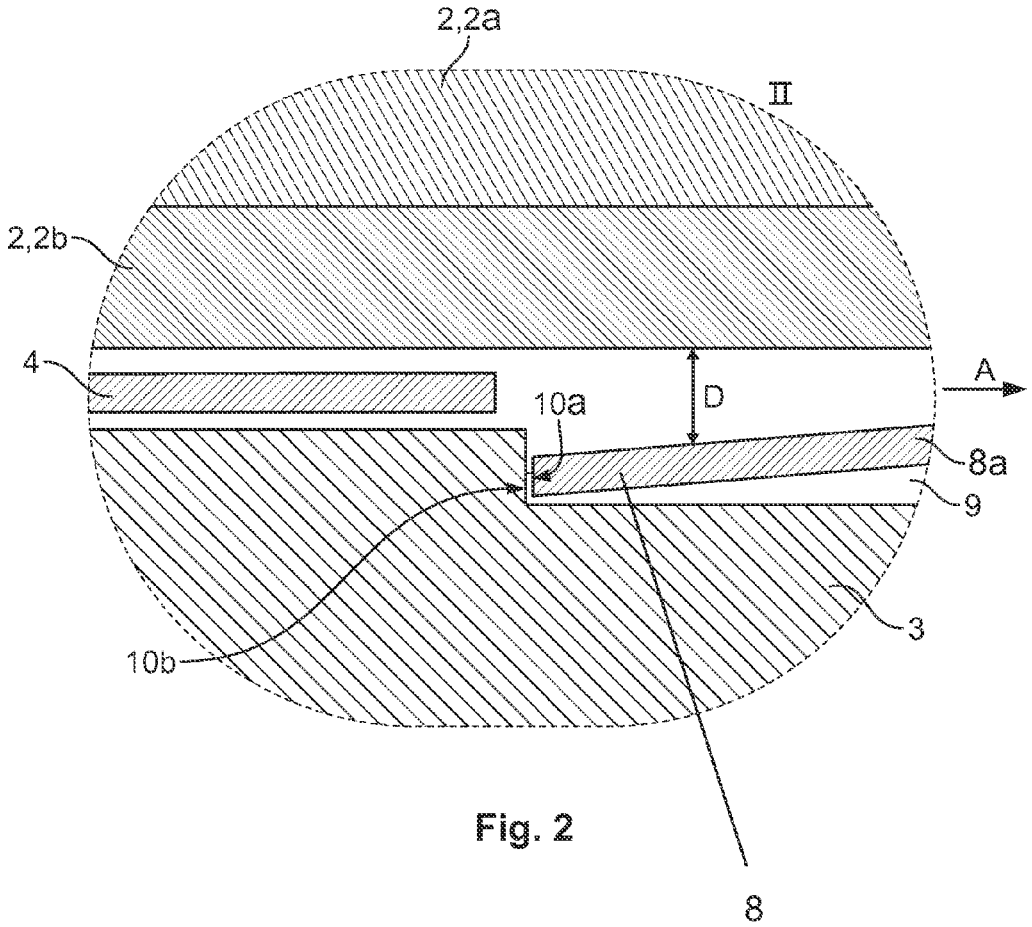
FIG. 2 is an enlarged view of the area II shown in FIG. 1.

FIG. 2 shows an enlarged view of the area marked with II in FIG. 1.

The figure shows the wire coil 2*a* and the bobbin 2*b* on top. The tube 4 is located between the wire coil 2 and the armature 3. The catch 8 in the form of a tongue 8*a* engages with a recess 9 of the armature 3 and blocks a movement of the armature 3 against an actuation direction A. The tongue 8*a* has been stamped out of a piece of metal sheet before the tube 4 has been rolled into its circular shape. Further, the tongue 8*a* has been bent inwards in order to engage with the recess 9 of the armature 3. A first shoulder 10*a* of the catch 8 engages with a second shoulder 10*b* located on the armature 3 and thus blocks the movement. As the armature 3 is the only moveable part, the actuator 1 can have a fast response time with a low consumption of power.

The tongue 8*a* is elastically deflectable in the deflection direction D which is perpendicular to the actuation direction A. This allows an easy assembling process, as the armature 3 can be introduced into the wire coil 2 in the actuation direction A. When the first shoulder 10*a* passes the second shoulder 10*b*, the catch 8 snaps into the recess 9 of the armature 3 and secures the armature 3 within the actuator 1.

Figure 3:
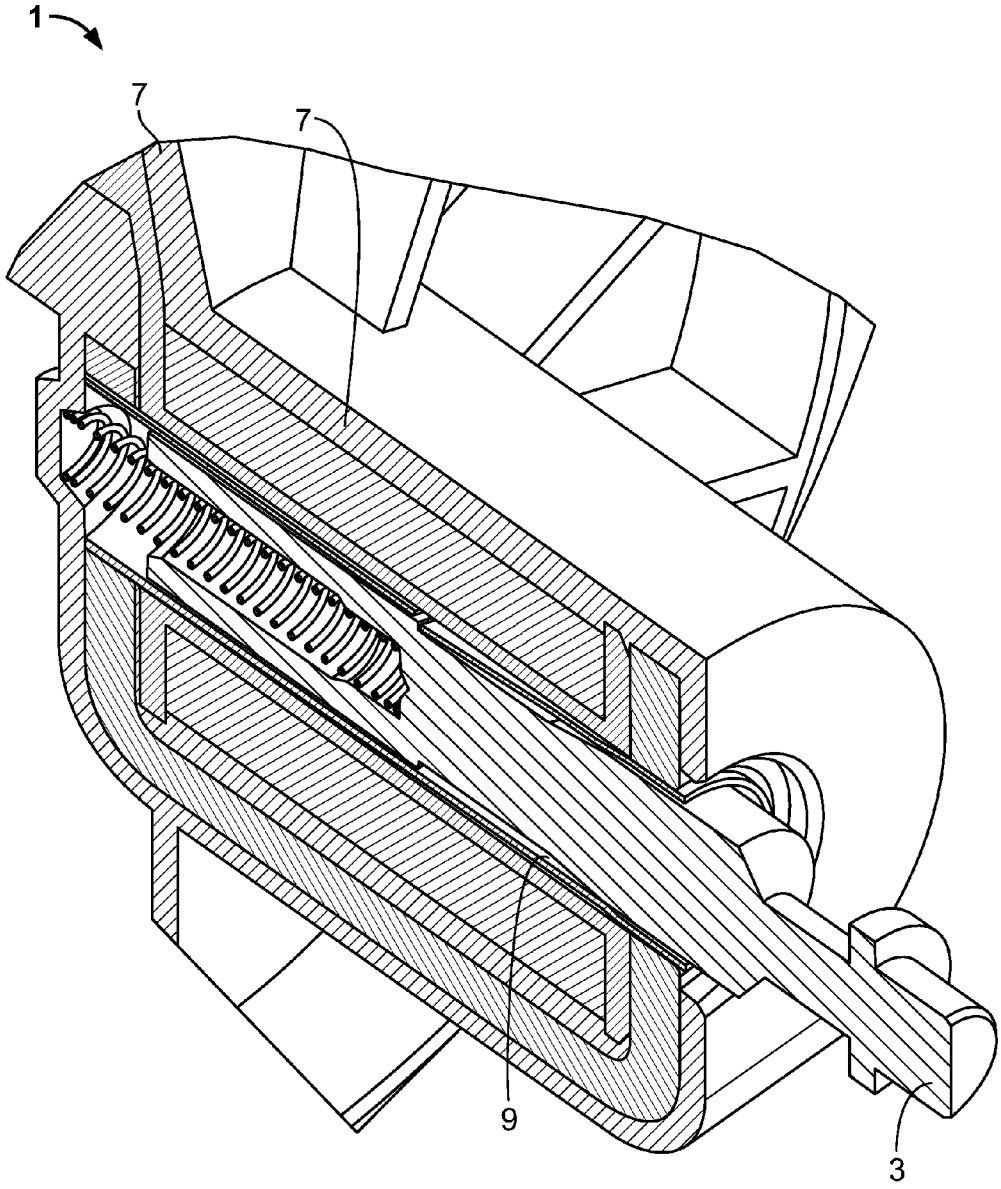
FIG. 3 is a schematic perspective sectional view of the electromagnetic actuator according to the invention shown in FIGS. 1 and 2.

In FIG. 3, it can be seen that the housing 7 can be part of a mounting assembly that allows mounting of the actuator 1. Further, it can be seen that the recess 9 on the armature 3 extends along a circumferential direction of the armature 3 around the actuation direction A. In particular, the recess 9 extends along the entire circumference of the armature 3, which allows free rotational movement of the armature 3 within the actuator 1.

Figure 4:
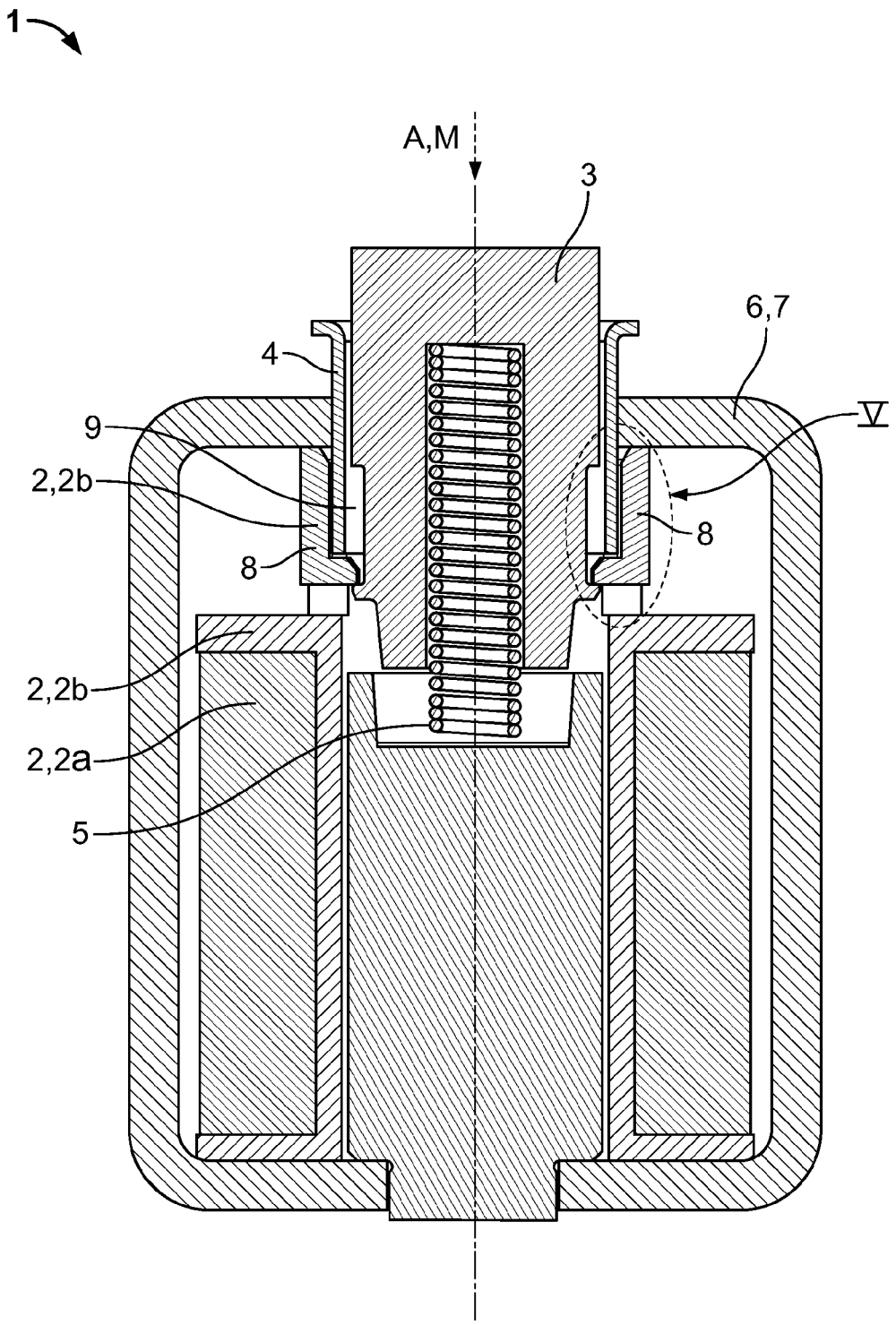
FIG. 4 is a schematic sectional view of a second embodiment of an electromagnetic actuator according to the invention.

FIG. 4 shows another example of an actuator 1 according to the invention. The armature 3 can be moved by running current through the wires 2*a* of the wire coil 2. The spring 5 biases the position of the armature 3 against the actuation direction A, which again is the insertion direction M. The armature 3 is partially located inside a tube 4, the tube 4 being located inside a yoke 6, which acts as a housing 7, and a bobbin 2*b* of the wire coil 2. Two catches 8 engage with a recess 9 of the armature 3. The recess 9 runs along the entire circumference of the armature 3 around the actuation direction A. In this example, the catch 8 is located on the bobbin 2*b* of the wire coil 2 and engages with the armature 3. The tube 4 only acts as a guiding surface that also reduces the friction between the armature 3 and the actuator 1.

In this case, two catches 8 engage in the recess 9 of the armature 3. This prevents the armature 3 from tilting within the actuator 1 and gives a better force distribution with smaller forces acting on the catches 8. However, any number of catches is possible.

Figure 5:
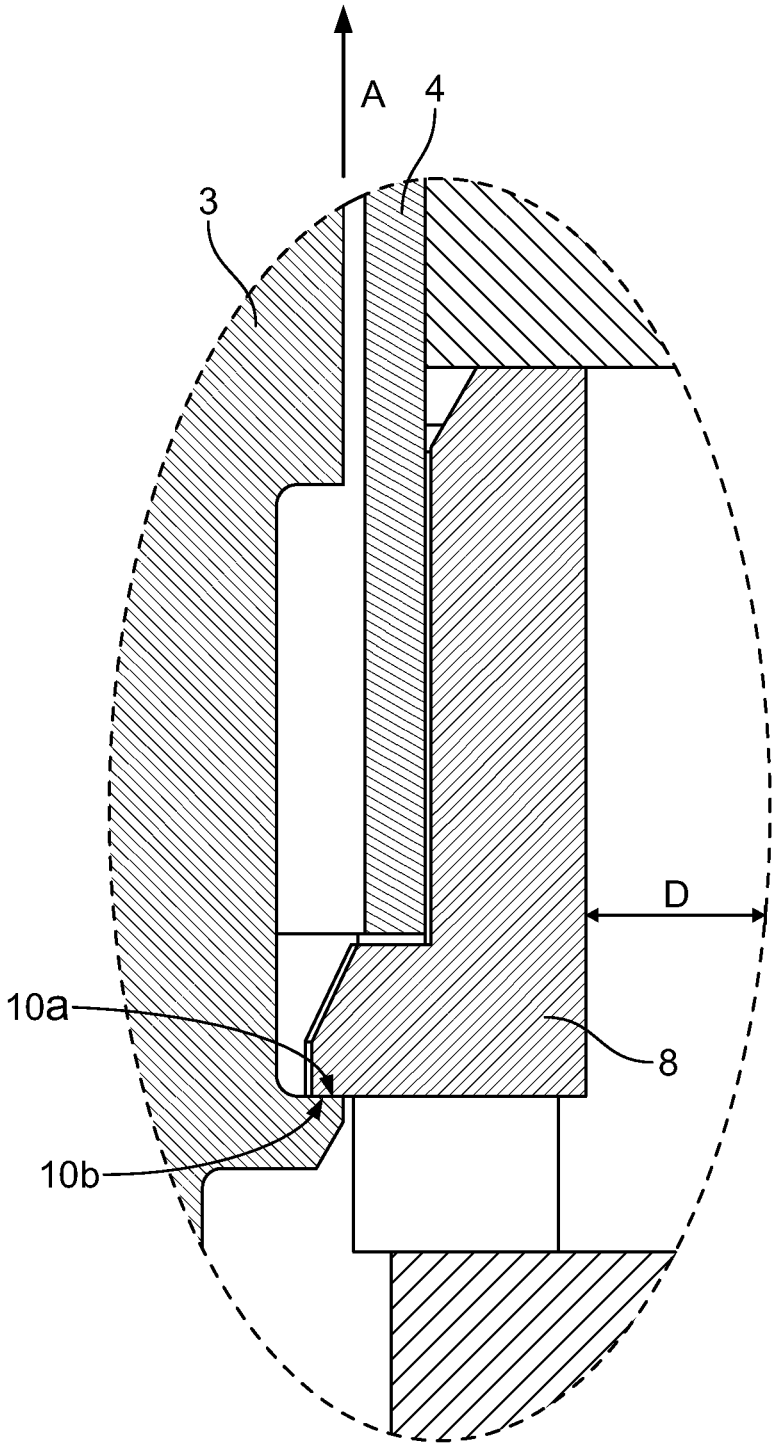
FIG. 5 is an enlarged view of the area marked with V in FIG. 4.

FIG. 5 shows an enlarged view of the area marked with V in FIG. 4. The catch 8 limits the movement of the armature 3 within the actuator in an actuation direction A. The first shoulder 10*a* is located on a protrusion of the catch 8 and interacts with a second shoulder 10*b*, which is located on a groove or recess of the armature 3. The first shoulder 10*a* and the second shoulder 10*b* are perpendicular to the actuation direction A, which allows slight movements of the armature 3 in the actuator 1 without blocking, but still secures the armature 3. The catch 8 is elastically deflectable in a deflection direction D that is orthogonal to the actuation direction A, which allows an insertion of the armature 3 into the wire coil 2 during assembly of the actuator 1 along the insertion direction M.

In this case, the tube 4 serves to minimize the friction and acts as a guiding surface during the movement of the armature 3 in the actuation direction A.

Figure 6:
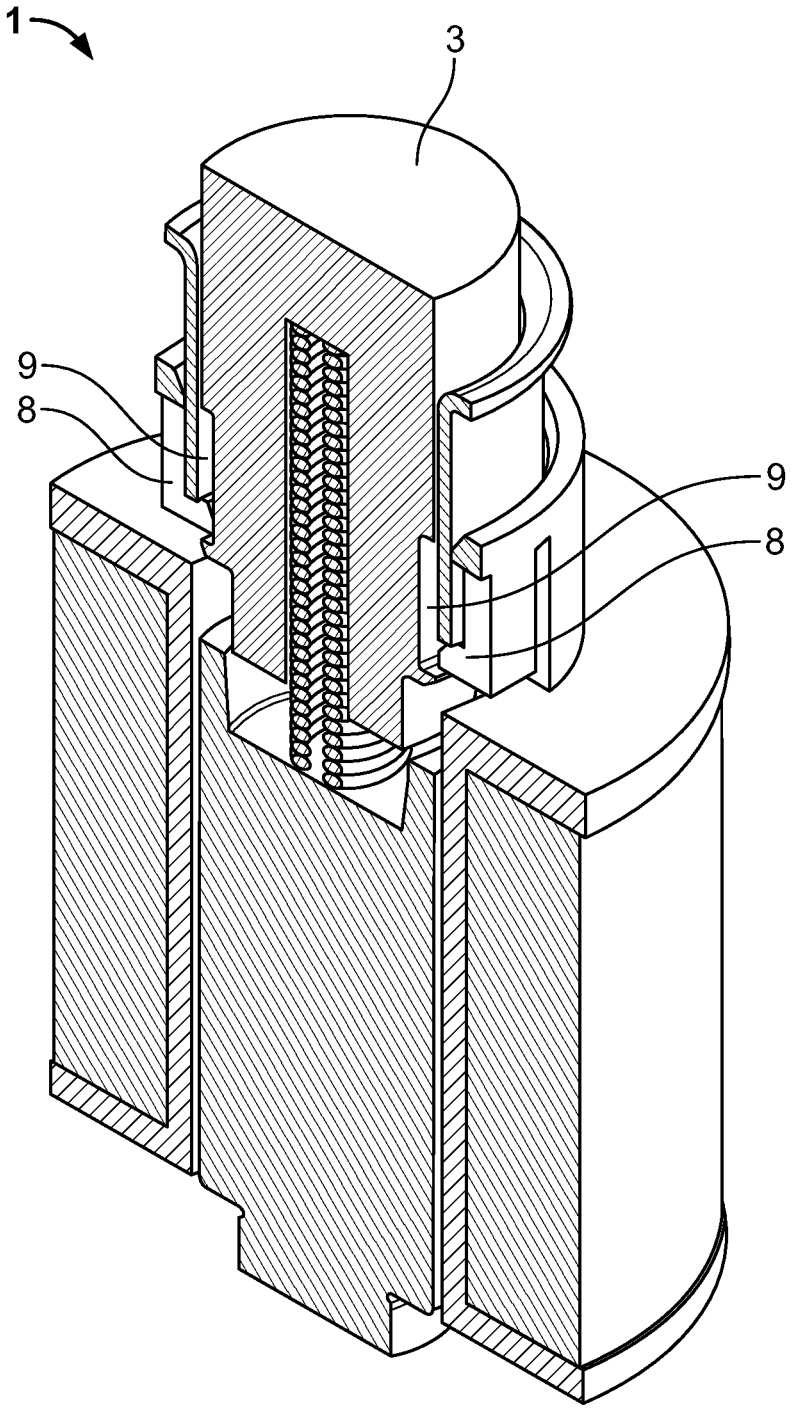
FIG. 6 is a schematic perspective sectional view of the electromagnetic actuator of FIGS. 4 and 5 with the housing removed.

FIG. 6 sectional view of the electromagnetic actuator 1 depicted in FIGS. 4 and 5 with the housing 7/yoke 6 removed. It can be seen that two catches 8 engage in a recess 9 of the armature 3. The two catches 8 are located opposite each other and thus distribute the force acting on the catches 8 and the armature 3 equally. The recess 9 can extend along the entire circumference of the armature 3, which allows a rotational movement of the armature 3 within the actuator 1.

The invention claimed is:

1. Electromagnetic actuator comprising a housing, a yoke coupled to the housing at an end thereof, a wire coil, an armature, a spring, and a catch, wherein the armature is profiled for movement in an actuation direction opposite to a force on the spring, the armature having a recess defining a shoulder, and wherein the catch secures the armature within the electromagnetic actuator, the catch being located inside the electromagnetic actuator, wherein the catch is elastic or elastically deflectable in a direction perpendicular to the actuation direction, and wherein the catch is integrally formed with a tube located between the armature and the wire coil, the catch having a single piece having a first end attached to the yoke inside the housing, and a second end having a flexible tongue that engages with the shoulder of the armature preventing the armature from disengaging.

2. Electromagnetic actuator according to claim 1, wherein the electromagnetic actuator has an insertion direction along which the armature is inserted into the electromagnetic actuator during assembly and that the armature is secured against the insertion direction by the catch.

3. Electromagnetic actuator according to claim 2, wherein the insertion direction is the actuation direction.

4. Electromagnetic actuator according to claim 1, wherein the tube comprises a tongue that acts as a catch.

5. Electromagnetic actuator according to claim 4, wherein the tongue is stamped or cut out from the tube.

6. Electromagnetic actuator according to claim 1, wherein the catch has a shoulder that engages with the shoulder located on the armature.

7. Electromagnetic actuator according to claim 6, wherein the first and/or second shoulder extends along a circumferential direction around the actuation direction.

8. Electromagnetic actuator comprising a housing, a yoke coupled to the housing at an end thereof, a wire coil, an armature, a spring, and a catch, wherein the armature is profiled for movement in an actuation direction opposite to a force on the spring, the armature having a recess defining a shoulder, and wherein the catch secures the armature within the electromagnetic actuator, the catch being located inside the electromagnetic actuator, wherein the catch is elastic or elastically deflectable in a direction perpendicular to the actuation direction, and wherein the catch is integrally formed with a tube located between the armature and the wire coil, the catch having a single piece having a first end attached to the yoke inside the housing, and a second end having a flexible tongue that engages with the shoulder of the armature preventing the armature from disengaging.

9. Electromagnetic actuator according to claim 8, wherein the electromagnetic actuator has an insertion direction along which the armature is inserted into the electromagnetic actuator during assembly and that the armature is secured against the insertion direction by the catch.

10. Electromagnetic actuator according to claim 8, wherein the insertion direction is the actuation direction.

11. Electromagnetic actuator according to claim 8, wherein the tube comprises a tongue that acts as a catch.

12. Electromagnetic actuator according to claim 11, wherein the tongue is stamped or cut out from the tube.

13. Electromagnetic actuator according to claim 8, wherein the catch has a shoulder that engages with a second shoulder, the shoulder located on the armature.

14. Electromagnetic actuator according to claim 13, wherein the first and/or second shoulder extends along a circumferential direction around the actuation direction.

* * * * *